US010615474B2

(12) United States Patent
Vaughn et al.

(10) Patent No.: US 10,615,474 B2
(45) Date of Patent: Apr. 7, 2020

(54) APPARATUSES AND METHODS FOR MODE SUPPRESSION IN RECTANGULAR WAVEGUIDE

(71) Applicant: Honeywell International Inc., Morris Plains, NJ (US)

(72) Inventors: Joseph Todd Vaughn, Lawrenceville, GA (US); Michael Koster, Johns Creek, GA (US)

(73) Assignee: Honeywell International Inc., Morris Plains, NJ (US)

( * ) Notice: Subject to any disclaimer, the term of this patent is extended or adjusted under 35 U.S.C. 154(b) by 119 days.

(21) Appl. No.: 15/903,941

(22) Filed: Feb. 23, 2018

(65) Prior Publication Data

US 2019/0267690 A1 Aug. 29, 2019

(51) Int. Cl.

| | |
|---|---|
| ***H01P 1/18*** | (2006.01) |
| ***H01P 1/24*** | (2006.01) |
| ***H01P 11/00*** | (2006.01) |
| ***H01P 3/12*** | (2006.01) |
| ***H01P 1/23*** | (2006.01) |
| ***H01P 1/19*** | (2006.01) |

(52) U.S. Cl.

CPC ..... *H01P 1/24* (2013.01); *H01P 1/182* (2013.01); *H01P 1/19* (2013.01); *H01P 1/23* (2013.01); *H01P 3/12* (2013.01); *H01P 11/002* (2013.01)

(58) Field of Classification Search

CPC .. H01P 1/182; H01P 1/181; H01P 1/18; H01P 1/222; H01P 1/23; H01P 3/12; H01P 1/19

USPC .... 333/158, 157, 156, 81 B, 81 R, 211, 239, 333/248, 251, 24.1

See application file for complete search history.

(56) References Cited

U.S. PATENT DOCUMENTS

| | | | | |
|---|---|---|---|---|
| 5,075,648 | A | 12/1991 | Roberts et al. | |
| 5,231,411 | A * | 7/1993 | Harrington | H01Q 13/22 343/770 |
| 5,597,322 | A | 1/1997 | Inaba et al. | |
| 6,972,727 | B1 | 12/2005 | West et al. | |
| 2010/0104236 | A1 | 4/2010 | Keating | |

OTHER PUBLICATIONS

Bardash et al, "Slot Line Digital Ferrite Phase Shifter", "Research and Development Technical Report, ECOM-0056-F", "AD748431", "U.S. Army Electronics Command—Fort Monmouth, N.J.", dated Aug. 1972, pp. 1-67.

RF Wireless, "What is mode Suppressor/ Circular Waveguide mode suppressor", "RF Wireless World", "http://www.rfwireless-world.com/Terminology/waveguide-mode-suppressor.html", Retreived on Jan. 8, 2018, pp. 1-4, Publisher: RF Wirlesss World 2012.

(Continued)

*Primary Examiner* — Stephen E. Jones

(74) *Attorney, Agent, or Firm* — Fogg & Powers LLC

(57) ABSTRACT

A rectangular waveguide device is provided. The rectangular waveguide device comprising: a first broad wall; a second broad wall parallel to the first broad wall; a first narrow wall perpendicular to and connected to the first broad wall and the second broad wall; a second narrow wall parallel to the first narrow wall and connected to the first broad wall and the second broad wall; and at least one slot in the first broad wall.

10 Claims, 5 Drawing Sheets

(56) References Cited

OTHER PUBLICATIONS

Tribak et al, "Novel Ridged Waveguide Differential Phase Shifter for Satellite Application", International Journal of Microwave and Optical Technology, vol. 9, No. 6, dated Nov. 2014, pp. 409-414, Publisher: IAMOT.
Wikipedia, "Slotted Line", "https://en.wikipedia.org/w/index.php?title=Slotted_line&oldid=788314167", Retrieved on Feb. 23, 2018, pp. 1-6.

* cited by examiner

APPARATUSES AND METHODS FOR MODE SUPPRESSION IN RECTANGULAR WAVEGUIDE

STATEMENT REGARDING FEDERALLY SPONSORED RESEARCH OR DEVELOPMENT

This invention was made with Government support by the United States Air Force. The Government has certain rights in this invention.

BACKGROUND

Toroidal phase shifters have been deployed for many decades. Toroidal phase shifters are formed by one or more portions of ferrite in a waveguide. Toroidal phase shifters may also be referred to as ferrite phase shifters. Phase shift is affected by the magnetized moments in the magnetized ferrite interacting with electromagnetic fields propagating through the waveguide. For latching ferrite phase shifters, latch wire(s) are placed through the center of the ferrite portion(s). Current flowing through the latch wire(s) is used to adjust the magnetized moments in the ferrite, and thus the amount of phase shift induced in electromagnetic fields propagating through the toroidal phase shifter.

Toroidal phase shifters formed in rectangular waveguide typically operate using an LSE10 electromagnetic mode. LSE is an acronym for longitudinally section electric. LSE electromagnetic modes occur in dielectrically loaded rectangular waveguides. Else, the modes are transverse electric (TE) modes. Electromagnetic mode may hereinafter be referred to a "mode".

The transition between the rectangular waveguide and the ferrite portion(s) (and possibly other materials such as dielectric(s) in the core of the ferrite portion(s)) is designed to reduce reflections, and thus return loss, for the LSE10 mode. Depending upon design of the toroidal phase shifter, e.g. waveguide and ferrite portion(s) design, the number of undesirable modes above waveguide cutoff frequency may vary.

A narrow band toroidal phase shifter can be designed so that the cutoff frequencies of some or all of the undesirable higher order modes are higher than the frequency band of interest, thus eliminating the undesirable higher order modes below the cut off frequencies. This may not possible or practical when designing a toroidal phase shifter to operate over a very broad bandwidth, e.g. at least one half of an octave bandwidth. The rectangular waveguide of a broadband toroidal phase shifter supports the propagation of two or more higher order modes, e.g. at least the LSE11 and LSE01 modes, and possibly the LSE20 mode—where each of these modes typically has a successively higher cut off frequency.

Because the transition between the rectangular waveguide and the ferrite portion(s) (and possibly other materials such as dielectric(s) in the core of the ferrite portion(s)) can not readily be designed to reduce reflections for undesirable higher order modes, the electromagnetic waves of the undesirable higher order modes are reflected. The reflections of the undesirable higher order modes cause resonances in the operating bandwidth of the toroidal phase shifter. The insertion loss and phase shift of the toroidal phase shifter at the resonant frequencies are dramatically changed, e.g. increased. As a result, the insertion losses and phase shifts at the resonances no longer are within desired parameter ranges. Furthermore the phase characteristics at the resonant frequencies are significantly impacted in such a way that may be detrimental to the system performance.

Resistive film imbedded in a center dielectric inside or between the ferrite toroid(s), and/or a dielectric transformer may be used to suppress the first undesirable higher order mode, the LSE11 mode, in a toroidal phase shifter. However, the next undesirable higher order modes, such as the LSE01 and LSE20 modes, typically need to be suppressed in the very broad band toroidal phase shifter.

Therefore, there has been a need for many decades for an approach to suppress the next undesirable higher order modes, such as the LSE01 and LSE20 modes, in broad band toroidal phase shifters.

SUMMARY

A rectangular waveguide device is provided. The rectangular waveguide device comprising: a first broad wall; a second broad wall parallel to the first broad wall; a first narrow wall perpendicular to and connected to the first broad wall and the second broad wall; a second narrow wall parallel to the first narrow wall and connected to the first broad wall and the second broad wall; and at least one slot in the first broad wall.

DRAWINGS

Embodiments of the present invention can be more easily understood and further advantages and uses thereof more readily apparent, when considered in view of the description of the preferred embodiments and the following figures in which.

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Microwave and millimeter wave rectangular waveguides are formed from conductors such as metal. Embodiments of the invention suppress at least the LSE01 and LSE20 modes in rectangular waveguide devices, such as a toroidal phase shifter or a circulator, by including at least one slot substantially along the centerline of, and running substantially the length of, at least one broad wall of the rectangular waveguide. Optionally, a dielectric, which can include ferrite, is located in such a waveguide with at least one slot in at least one broad wall. Thus, their may be at least one slot in one broad wall, or in both broad walls of the rectangular waveguide. The slot may have a depth that is all or a portion of the thickness of the broad wall as will be further described. Although applicable to other rectangular waveguide devices, embodiments of the invention will be illustrated for toroidal phase shifters.

For example, another rectangular waveguide device could be a broad band rectangular waveguide having a lower frequency, e.g. implemented by larger broad wall and side wall dimensions, and the slots described herein to suppress higher order modes at higher frequencies so has to have an increased upper frequency. This technique thus can be used to increase the upper frequency limit of a rectangular waveguide. This technique may facilitate higher power operation than alternative techniques for implementing broad band waveguide such as using ridge waveguide. In this embodiment, no dielectric such as a ferrite is inserted in the waveguide.

In one embodiment, the slot has a substantially rectangular cross section parallel to the inner surface of the broad wall in which the slot is located. In another embodiment, as will be subsequently illustrated, the slot also has a substantially rectangular cross section perpendicular to the inner surface of the broad wall. Alternatively, the cross sections may be rectangles with rounded corners or rounded ends.

The broad wall of rectangular waveguide is a wall whose length is longer than the length of the narrow wall. For example, when viewing an opening (or port) of the rectangular waveguide, parallel to axis BB, the broad wall width is twice the narrow wall width. The absolute width of each wall depends upon the operating frequency range of the waveguide.

Figure 1A:
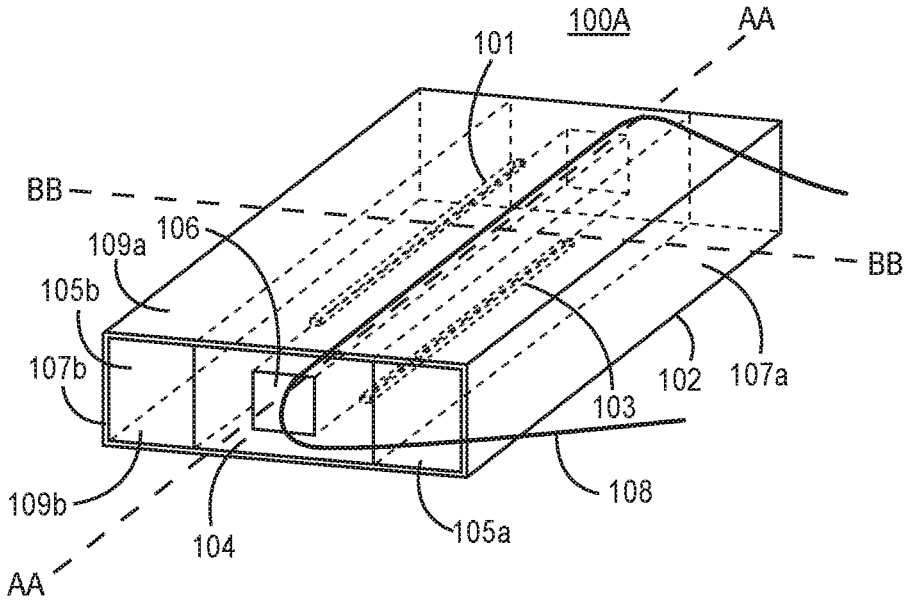
FIG. 1A illustrates a diagram of one embodiment of a single toroidal phase shifter including slotted waveguide.

FIG. 1A illustrates a diagram of one embodiment of a single toroidal phase shifter including slotted waveguide (single toroidal phase shifter) 100A. The single toroidal phase shifter 100A comprises rectangular waveguide 102. The rectangular waveguide 102 has a first broad wall 109*a* and a second broad wall 109*b*; the two broad walls are parallel to one another. The rectangular wave guide 102 has a first narrow wall 107*a* and a second narrow wall 107*b*; the two narrow walls are parallel to one another. Each narrow wall is perpendicular to each broad wall, and visa versa.

The first narrow wall 107*a* connects a first end of the first broad wall 109*a* to a first end of the second broad wall 109*a*. The second narrow wall 107*b* connects a second end of the first broad wall 109*a* to a second end of the second broad wall 109*b*. In the illustrated embodiment, two spaces 105*a*, 105*b*, e.g. filled by a vacuum or air, separate the first and second sides of the toroidal ferrite 104 respectively substantially abut, in a flush manner, the first narrow wall 107*a* and the second narrow wall 107*b*.

The toroidal ferrite 104 has an opening filled with dielectric 106. The dielectric 106 may be a vacuum, air, or a solid material, e.g. Trans-tech D13 or D16 ceramic. A conductor 108, such as a metal wire, runs through the dielectric 106. The conductor 108 is the latch wire through which current flows to adjust the magnetized moments in the ferrite, and thus the amount of phase shift induced in electromagnetic fields propagating through the single toroidal phase shifter 100A.

The first broad wall 109*a* has at least one first slot 101 substantially along the centerline of, and substantially along the full length of, the first broad wall 109*a*. Optionally, the second broad wall 109*b* has at least one second slot 103 substantially along the centerline of, and substantially along the full length of, the second broad wall 109*b*. The centerlines are parallel to axis AA illustrated in FIG. 1A. Implementations of the first slot 101 and the second slot 103 will be subsequently described.

Figure 1B:
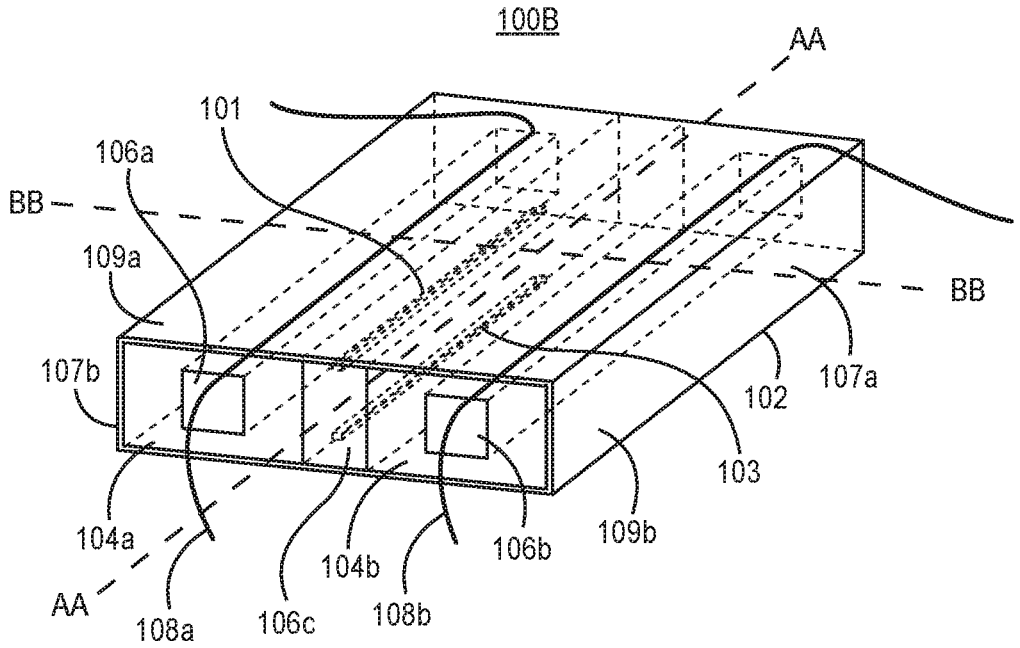
FIG. 1B illustrates a diagram of one embodiment of a dual toroidal phase shifter including slotted waveguide.

FIG. 1B illustrates a diagram of one embodiment of a dual toroidal phase shifter including slotted waveguide (dual toroidal phase shifter) 100B. The dual toroidal phase shifter 100B is analogous to the single toroidal phase shifter 100A but includes a first toroidal ferrite 104*a* and a second toroidal ferrite 104*b* separated by a third dielectric 106*c*. The first toroidal ferrite 104*a* is filled with a first dielectric 106*a*. The second toroidal ferrite 104*b* is respectively filled with a second dielectric 106*b*. A first conductor 108*a* and a second conductor 108*b* run respectively through the first dielectric 104*a* and the second dielectric 104*b*. Opposite surfaces of toroidal ferrite 104 contact, in a substantially flush manner, the interior surfaces of the first broad wall 109*a* and the second broad wall 109*b*.

The first broad wall 109*a* has at least one first slot 101 substantially along the centerline of, and substantially along the full length of, the first broad wall 109*a*. Optionally, the second broad wall 109*b* has at least one second slot 103 substantially along the centerline of, and substantially along the full length of, the second broad wall 109*b*. The centerlines are parallel to axis AA illustrated in FIG. 1B. Implementations of the first slot 101 and the second slot 103 will be subsequently described.

The slots 101, 103 may penetrate all or partially through the broad walls 109*a*, 109*b* of the rectangular waveguide 102. Slot(s) in the rectangular waveguide 102 will be described now in further detail. The subsequent discussion of slot(s) in rectangular waveguide 102 also applies to toroidal phase shifters that are made in rectangular waveguide 102.

The cross sections slots illustrated in FIGS. 2A-D are along an axis parallel to axis AA of FIGS. 1A and 1B. The following reference to axis BB is to axis BB in FIGS. 1A and 1B. As illustrated in FIGS. 2A-D, each slot has a depth d, length l (along an axis parallel to axis AA), and a width (along an axis parallel to axis BB). The width is as small as permitted by the manufacturing technology used to fabricate, e.g. machine, the slot in the broad wall 209*a* to diminish an increase to the return loss of the fundamental mode propagating in the rectangular waveguide 102. The slots are oriented to be invisible to the fundamental mode. The slots are designed to suppress the LSE01 and LSE20 modes by interrupting currents that would arise from those modes.

Figure 2A:
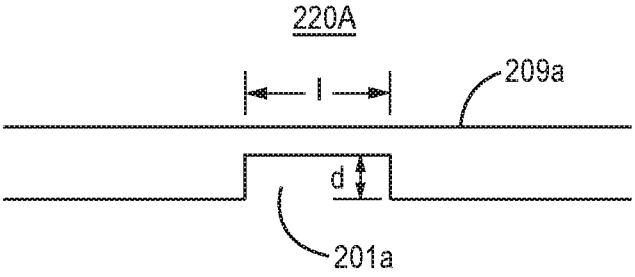
FIG. 2A illustrates a cross section of one embodiment of a shorted slot in a broad wall of rectangular waveguide.

FIG. 2A illustrates a cross section of one embodiment of a shorted slot in a broad wall of rectangular waveguide 220A. The shorted slot 201 does not penetrate both sides of the broad wall 209*a*, and thus is terminated by conductor forming the broad wall 209*a*. Each shorted slot 201 has a depth d, length l (along an axis parallel to axis AA), and a width (along an axis parallel to axis BB). Because the length of a shorted slot 201 can correspond to a wavelength just below the cutoff wavelength of the lowest wavelength of the fundamental mode, even energy from an evanescent field of the fundamental mode can be coupled into a shorted slot 201. Optionally, for shorted slots, depth d is equal to or greater than one eighth of the lowest wavelength of fundamental mode propagating in the shorted slots.

Figure 2B:
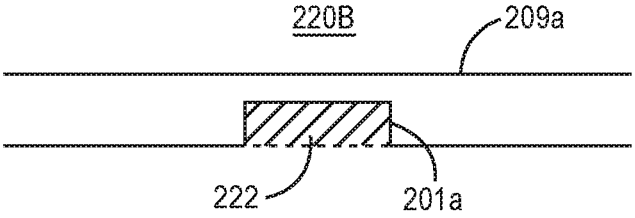
FIG. 2B illustrates a cross section of one embodiment of a shorted slot that is filled with a broadband electromagnetic absorber.

FIG. 2B illustrates a cross section of one embodiment of a shorted slot that is filled with a broadband electromagnetic absorber 220B. The broadband electromagnetic absorber 222 may be fabricated with an insulator embedded with conductive material (such as epoxy containing iron fragments), metamaterial, nanostructures made from carbon or other material, or any other type of broadband electromagnetic absorbing material. The broadband electromagnetic absorber 220B absorbs electromagnetic radiation over at least the bandwidth in which undesirable higher order modes that are sought to be suppressed. Although FIG. 2B illustrates that the shorted slot 201*a* is completely filled with the broadband electromagnetic absorber 222, the shorted slot 201*a* may only be partially filled. For example, the broadband electromagnetic absorber 222 covers the width and length l, but not the complete depth d, of the shorted slot 201*a*. An injection process may be used to fill the shorted slot 201*a* with the broadband electromagnetic absorber 222. For embodiments when broadband electromagnetic absorber 222 is used in or about slots that are shorted or not, the depth d of the corresponding slots are not critical.

Figure 2C:
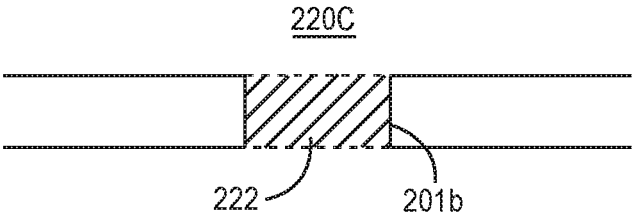
FIG. 2C illustrates a cross section of one embodiment of a non-shorted slot that is filled with broadband electromagnetic absorber.

FIG. 2C illustrates a cross section of one embodiment of a non-shorted slot that is filled with broadband electromagnetic absorber 220C. A non-shorted slot 201*b* is a slot where at least part of the cross section of the slot penetrates from the interior surface of a broad wall through the exterior surface of the broad wall; in one embodiment, all of the cross section of the slot penetrates through the exterior surface of the corresponding broad wall. Although FIG. 2C illustrates that the non-shorted slot 201*b* is completely filled with the broadband electromagnetic absorber 222, the non-shorted slot 201*b* may only be partially filled with the broadband electromagnetic absorber 222. For example, the broadband electromagnetic absorber 222 covers the width and length l, but not the complete depth d, of the non-shorted slot 201*b*. An injection process may be used to fill the shorted slot 201*a* with the broadband electromagnetic absorber 222.

Figure 2D:
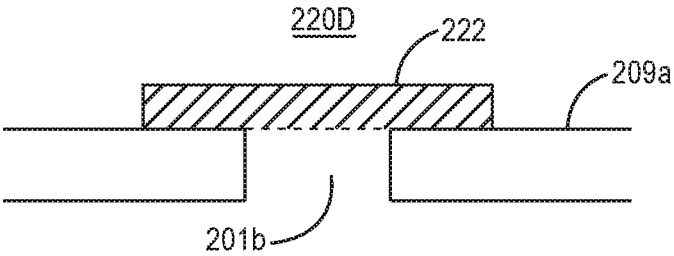
FIG. 2D illustrates a cross section of one embodiment of a non-shorted slot that has one surface of the broad wall and one end of the non-shorted slot covered by the broadband electromagnetic absorber.

FIG. 2D illustrates a cross section of one embodiment of a non-shorted slot that has one surface of the broad wall and one end of the non-shorted slot covered by the broadband electromagnetic absorber 222. The surface may be the exterior or interior surface of the broad wall; the interior surface is within the interior of the rectangular waveguide. In one embodiment, the broadband electromagnetic absorber 222 can be an adhesive backed broadband electromagnetic absorber, such as Laird Technologies' Eccosorb BSR-1/SS6M, that adheres to an exterior surface of the broad wall. Although it is possible to use a non-shorted slot 201*b* that is not covered, or only partially covered or filled along its length l, with broadband electromagnetic absorber 222, this may be less desirable including because electromagnetic energy can undesirably radiate through resulting openings in the non-shorted slots 201*b*. Note, different broadband electromagnetic absorber material can be used to cover and/or at least partially fill different slots, e.g. in the first broad wall 109*b* versus the second broad wall 109*b*, or even in the same broad wall.

Figure 3A:
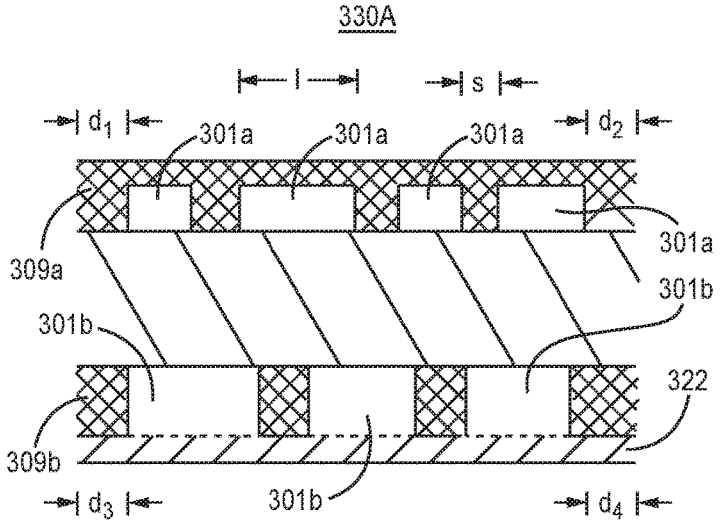
FIG. 3A illustrates a cross section along the centerline of the broad walls (centerline) of one embodiment of a rectangular waveguide having a first broad wall having shorted slots and a second broad wall having non-shorted slots.

Various embodiments of slots which can be implemented in rectangular waveguide 102 will now be illustrated. FIG. 3A illustrates a cross section along the centerline of the broad walls (centerline) of one embodiment of a rectangular waveguide having a first broad wall having shorted slots and a second broad wall having non-shorted slots 330A. The centerline projects from one broad wall through axis AA to the other broad wall. The slots in the broad walls illustrated in FIGS. 3A-3E are located along axes parallel to axis AA. The subsequent illustration portrays only shorted or non-shorted slots being implemented in a single broad wall. However, it is contemplated that both shorted and non-shorted slots could be implemented in the same broad wall.

In the embodiment illustrated in FIG. 3A, the first broad wall 309*a* is comprised of at least one shorted slot 301*a*. Although FIG. 3A illustrates the first broad wall 309*a* having multiple shorted slots 301*a*, alternatively the first broad wall 309*a* could have one, two, three, or more shorted slots 301*a*. Thus, the first broad wall 309 includes at least one shorted slot 301*a*. The end of the shorted slot(s) 301*a* proximate to each end of the rectangular waveguide 102 is displaced from each end respectively by distances d1 and d2 where d1 and d2 can be equal or not equal. In one embodiment, d1 and d2 are less than one half of a wavelength of the lowest wavelength of an operating band of the LSE01 & LSE20 modes in the toroidal phase shifter.

The shorted slot(s) 301*a* reflect energy which can cause resonances in return loss and insertion loss of the waveguide device. In one embodiment, as illustrated in FIG. 3A, to avoid having a single resonance in the rectangular waveguide's insertion and return losses, the first broad wall includes multiple shorted slots 301*a*. To further minimize the likelihood of resonances, the length of each shorted slot 301*a* and the spacing between each shorted slot 301*a* can be varied, e.g. randomly. This results in out of phase reflections that diminish or eliminate the resonances. In one embodiment, the spacing and distance can be determined for a given design using an optimizer in a finite element analysis electromagnetic simulator; thus the spacing would vary but not randomly. The structural integrity and the thermal dissipation property of the rectangular waveguide 102 should also be considered when shortening spacings between shorted slots 301*a*. Further, when the second broad wall 309*b* includes slots with a broadband electromagnetic absorber 222, resonances are suppressed so that the number, length, and spacing of the shorted slot(s) 301*a* become less critical.

In one embodiment, at least one of the broad walls comprises three or more shorted slots 301*a*. Two or more of the shorted slots have different lengths along the corresponding broad wall. The spacings, along the corresponding broad wall, between two or more sets of two of the shorted slots have different lengths.

In the embodiment illustrated in FIG. 3A, the second broad wall 309*b* is comprised of at least one non-shorted slot 301*b* covered by a broadband electromagnetic absorber 322. Although FIG. 3A illustrates the second broad wall 309*b* having multiple non-shorted slots 301*b*, alternatively the second broad wall 309*b* could have a one, two, three or more non-shorted slots 301*b*. Although FIG. 3A illustrates the use of broadband electromagnetic absorber 322 with the non-shorted slots 301*b* in the second broad wall 309*b* as described with respect to FIG. 2D, slot(s) and broadband electromagnetic absorber 222 can be alternatively implemented as described with respect to FIGS. 2B and 2C.

The ends of the non-shorted slot(s) 301*b* proximate to each end of the rectangular waveguide 102 are displaced from each end respectively by distances d3 and d4 where d3 and d4 can be equal or not equal. In one embodiment, d3 and d4 are less than one half of a wavelength of the lowest wavelength of an operating band of the LSE01 and LSE20 modes in the toroidal phase shifter.

The length of each non-shorted slot 301*b* needs to be about or above the cutoff frequency of the fundamental, LSE10, mode of the toroidal phase shifter so that the electromagnetic energy is converted to a fundamental, LSE10, mode of the corresponding non-shorted slot 301*b*. Because the broadband electromagnetic absorber 222 absorbs energy that would otherwise be converted to the undesirable higher order modes, e.g. the LSE01 and LSE20 modes, reflections are not created and the length and spacing of the non-shorted slots 301*b* need not be random or of a specific design to diminish reflections. The spacings between pairs of non-shorted slots 301*b* can be as short as possible without detrimentally undermining the structural integrity and the thermal dissipation property of the rectangular waveguide 102.

Figure 3B:
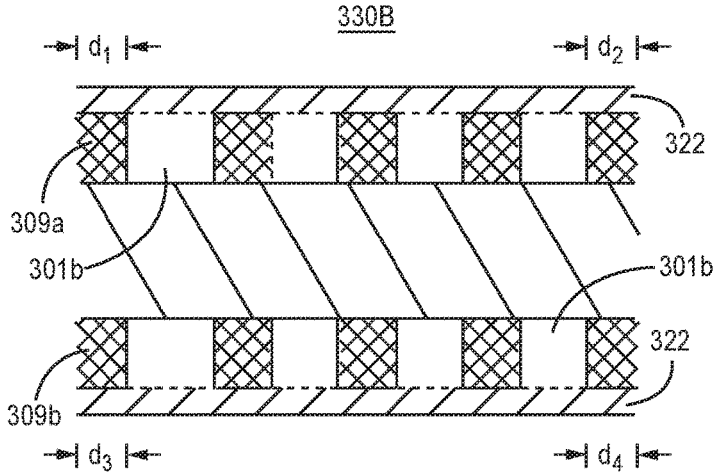
FIG. 3B illustrates a cross section of one embodiment of a rectangular waveguide having a first broad wall having non-shorted slots and a second broad wall having non-shorted slots.

FIG. 3B illustrates a cross section along the centerline of the broad walls (centerline) of one embodiment of a rectangular waveguide having a first broad wall having non-shorted slots and a second broad wall having non-shorted slots 330B. In the embodiment illustrated in FIG. 3B, the first broad wall 309*a* and the second broad wall 309*a* each comprise at least one non-shorted slot 301*b* covered by a broadband electromagnetic absorber 322. The design of the non-shorted slots and the broadband electromagnetic absorber 322 is as described above. Although FIG. 3B illustrates the use of broadband electromagnetic absorber 322 with the non-shorted slots 301*b* in the first broad wall 309*a* and the second broad wall 309*b* as described with respect to FIG. 2D, slot(s) and broadband electromagnetic absorber 222 can be alternatively implemented as described with respect to FIGS. 2B and 2C.

Figure 3C:
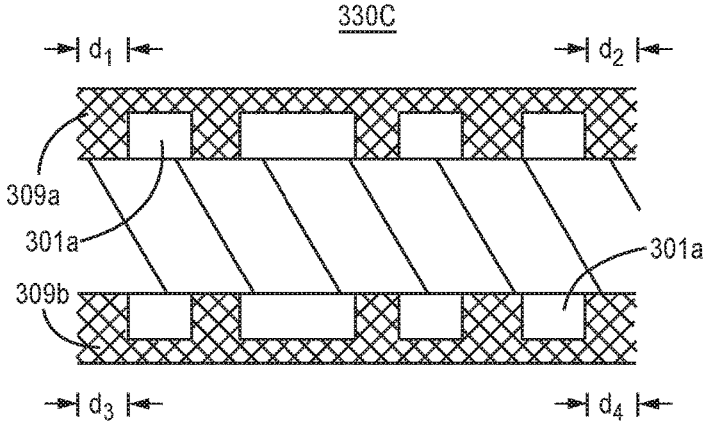
FIG. 3C illustrates a cross section along the centerline of broad walls of one embodiment of a rectangular waveguide having a first broad wall having shorted slots and a second broad wall having shorted slots.

FIG. 3C illustrates a cross section along the centerline of the broad walls (centerline) of one embodiment of a rectangular waveguide having a first broad wall having shorted slots and a second broad wall having shorted slots 330C. The first broad wall 309*a* and the second broad wall 309*b* each include at least one shorted slot 301*a*. To enhance suppression of the aforementioned resonances, the number, length, and spacings of the shorted slot(s) 301*a* should be implemented as described above.

Figure 3D:
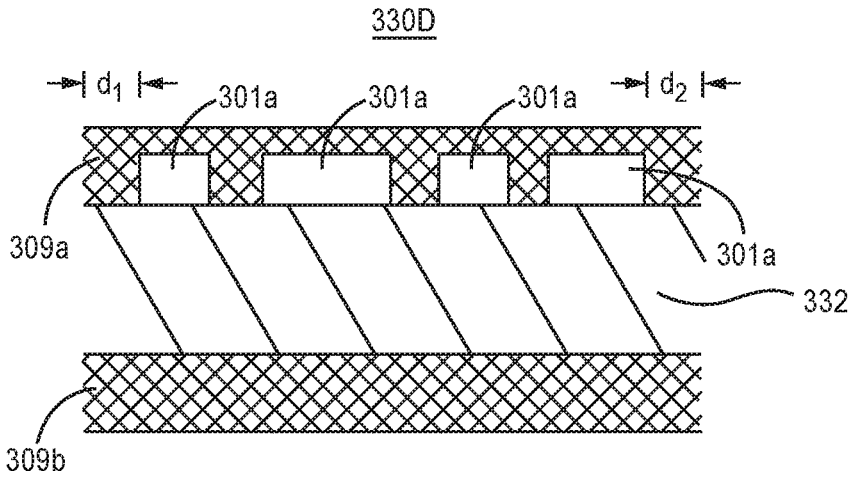
FIG. 3D illustrates a cross section along the centerline of broad walls of one embodiment of a rectangular waveguide having a first broad wall having shorted slots and a second broad wall having no slots.

FIG. 3D illustrates a cross section along the centerline of the broad walls (centerline) of one embodiment of a rectangular waveguide having a first broad wall having shorted slots and a second broad wall having no slots 330D. The first broad wall 309*a* includes at least one shorted slot 301*a*. The second broad wall 309*b* has not slots. This design is less effective in suppressing undesirable higher modes, and to enhance suppression of the aforementioned resonances, the number, length, and spacing of the shorted slot(s) 301*a* should be implemented as described above.

Figure 3E:
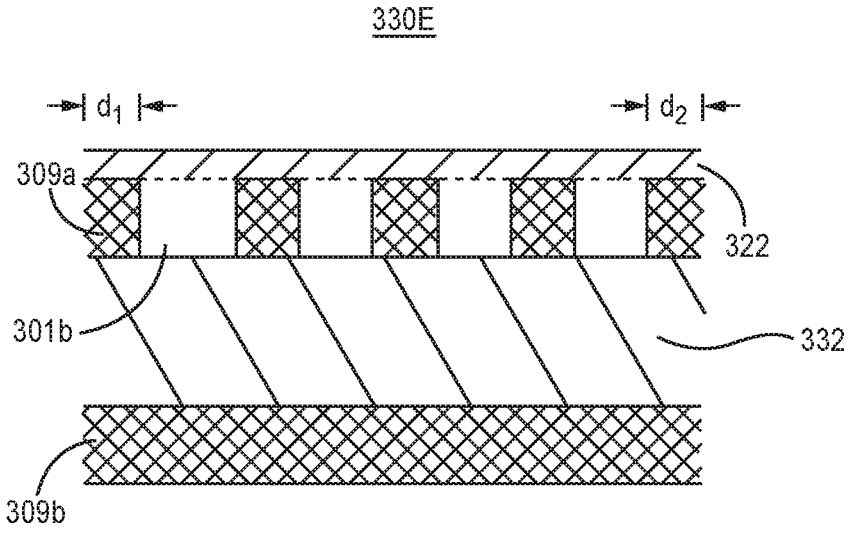
FIG. 3E illustrates a cross section along the centerline of broad walls of one embodiment of a rectangular waveguide having a first broad wall having non-shorted slots and a second broad wall having no slots.

FIG. 3E illustrates a cross section along the centerline of the broad walls (centerline) of one embodiment of a rectangular waveguide having a first broad wall having non-shorted slots and a second broad wall having no slots 330E. In the embodiment illustrated in FIG. 3E, the first broad wall 309*a* is comprised of at least one non-shorted slot 301*b* covered by a broadband electromagnetic absorber 222. The second broad wall has not slots. This design is less effective in suppressing undesirable higher order modes. The design of the non-shorted slots and the broadband electromagnetic absorber 222 is as described above. Although FIG. 3E illustrates the use of broadband electromagnetic absorber 322 with the non-shorted slots 301*b* in the first broad wall 309*a* as described with respect to FIG. 2D, slot(s) and broadband electromagnetic absorber 222 can be alternatively implemented as described with respect to FIGS. 2B and 2C.

Figure 4:
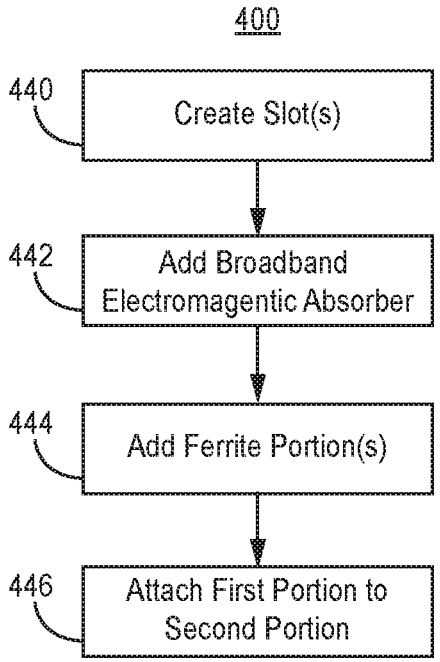
FIG. 4 illustrates an exemplary method of manufacturing a rectangular waveguide device configured to suppress undesirable higher order modes.

FIG. 4 illustrates an exemplary method of manufacturing a rectangular waveguide device configured to suppress undesirable higher order modes. To the extent the method 400 shown in FIG. 4 is described herein as being implemented in the devices shown in FIGS. 1A-3E, it is to be understood that other embodiments can be implemented in other ways. The blocks of the flow diagrams have been arranged in a generally sequential manner for ease of explanation; however, it is to be understood that this arrangement is merely exemplary, and it should be recognized that the processing associated with the methods (and the blocks shown in the Figures) can occur in a different order (for example, where at least some of the processing associated with the blocks is performed in parallel and/or in an event-driven manner).

In block 440, create at least one slot in at least one broad wall of, e.g. a first portion of, a rectangular waveguide. The at least one slot may be one shorted slot and/or non-shorted slot. The at least one slot in the broad wall of a first portion is configured to suppress undesirable higher order modes. In one embodiment, the rectangular waveguide is a unitary piece, and non-shorted slots are made in each broad wall. In another embodiment, the rectangular waveguide is comprised of a first portion and a second portion, e.g. respectively a tub having a U shaped cross section and a lid. For example, the sides and bottom of the tub are respectively the first narrow wall 107*a*, the second narrow wall 107*b*, and the second broad wall 109*b*, and the lid is the first broad wall 109*a*. However, the rectangular waveguide may be otherwise segregated into two portions, including by having two U shaped portions each formed by one broad wall and portions of each narrow wall.

In one embodiment, at least one shorted slot and/or non-shorted slot are made in each broad wall of the rectangular waveguide, e.g. in the broad wall of each portion of the rectangular waveguide. The at least one slot in each broad wall is configured to suppress undesirable higher order modes. In a further embodiment, the slots are made in the broad walls by mechanical milling or laser milling.

Optionally, in block 442, add broadband electromagnetic absorber. In one embodiment, the broadband electromagnetic absorber is wholly or partially deposit, e.g. using injection techniques, within the non-shorted slots or shorted slots. In another embodiment, the broadband electromagnetic absorber is deposited over the exterior surface of at least one broad wall and over non-shorted slots, e.g. as described above for broadband electromagnetic absorber using an adhesive; the interior surface is within the rectangular waveguide and the exterior surface is opposite the interior surface.

Optionally, in block 444, add ferrite portion(s) to the rectangular waveguide. In one embodiment, the ferrite portion(s) are inserted into a tub portion of the rectangular waveguide. In another embodiment, the ferrite portion(s) are inserted, e.g. slid, into rectangular waveguide.

Optionally, in block 446, if the rectangular waveguide is formed by two portions, the two portions are attached. For example the portions can be attached by brazing, soldering, or welding.

Advantageously, embodiments of the present invention facilitate broad band waveguides and toroidal phase shifters having substantially flat insertion and return loss over a wide bandwidth.

EXAMPLE EMBODIMENTS

Example 1 includes a rectangular waveguide device, comprising: a first broad wall; a second broad wall parallel to the first broad wall; a first narrow wall perpendicular to and connected to the first broad wall and the second broad wall; a second narrow wall parallel to the first narrow wall and connected to the first broad wall and the second broad wall; and at least one slot in the first broad wall.

Example 2 includes the rectangular waveguide device of Example 1, wherein the at least one slot comprises at least one non-shorted slot that is at least one of: covered by a first broadband electromagnetic absorber and at least partially filled with a second broadband electromagnetic absorber.

Example 3 includes the rectangular waveguide device of Example 2, wherein the first broadband electromagnetic absorber and the second broadband electromagnetic absorber comprise the same material.

Example 4 includes the rectangular waveguide device of any of Examples 1-3, wherein the at least one slot comprises at least one shorted slot.

Example 5 includes the rectangular waveguide device of Example 4, wherein the at least one shorted slot is at least partially filled with a first broadband electromagnetic absorber.

Example 6 includes the rectangular waveguide device of any of Examples 1-5, wherein the at least one shorted slot comprises three or more shorted slots; wherein two or more of the shorted slots have a different lengths, and wherein spacings between two or more sets of two of the shorted slots have different lengths.

Example 7 includes the rectangular waveguide device of any of Examples 1-6, wherein the end of each slot proximate to an end of the rectangular waveguide device is displaced by less than one half of a wavelength of the lowest wavelength of an operating band of a fundamental mode in the rectangular waveguide device.

Example 8 includes the rectangular waveguide device of any of Examples 1-7, further comprising at least one slot in the second broad wall.

Example 9 includes the rectangular waveguide device of Example 8, wherein the at least one slot of the second broad wall is identical to the at least one slot of the first broad wall; and if the at least one slot of the first broad wall is at least one of: covered by a first broadband electromagnetic absorber and at least partially filled with a second broadband electromagnetic absorber, the second broad wall is also at least one of: covered by the first broadband electromagnetic absorber and at least partially filled with the second broadband electromagnetic absorber.

Example 10 includes the rectangular waveguide device of Example 9, wherein the first broadband electromagnetic absorber and the second broadband electromagnetic absorber comprise the same material.

Example 11 includes a phase shifter, comprising: a first broad wall having a first surface; a second broad wall parallel to the first broad wall and having a second surface; a first narrow wall perpendicular to and connected to the first broad wall and the second broad wall; a second narrow wall parallel to the first narrow wall and connected to the first broad wall and the second broad wall; at least one ferrite portion having a third surface and a fourth surface; wherein the first surface substantially contacts the third surface; wherein the second surface substantially contacts the fourth surface; and at least one slot in the first broad wall.

Example 12 includes the rectangular waveguide device of Example 11, wherein the at least one slot comprises at least one non-shorted slot that is at least one of: covered by a first broadband electromagnetic absorber and at least partially filled with a second broadband electromagnetic absorber.

Example 13 includes the rectangular waveguide device of Example 12, wherein the first broadband electromagnetic absorber and the second broadband electromagnetic absorber comprise the same material.

Example 14 includes the rectangular waveguide device of any of Examples 11-13, wherein the at least one slot comprises at least one shorted slot.

Example 15 includes the rectangular waveguide device of Example 14, wherein the at least one shorted slot is at least partially filled with a first broadband electromagnetic absorber.

Example 16 includes the rectangular waveguide device of any of Examples 11-15, wherein the at least one shorted slot comprises three or more shorted slots; wherein two or more of the shorted slots have a different lengths, and wherein spacings between two or more sets of two of the shorted slots have different lengths.

Example 17 includes the rectangular waveguide device of any of Examples 11-16, wherein the end of each slot proximate to an end of the rectangular waveguide device is displaced by less than one half of a wavelength of the lowest wavelength of an operating band of a fundamental mode in the rectangular waveguide device.

Example 18 includes the rectangular waveguide device of any of Examples 11-17, further comprising at least one slot in the second broad wall.

Example 19 includes the rectangular waveguide device of Example 18, wherein the at least one slot of the second broad wall is identical to the at least one slot of the first broad wall; and if the at least one slot of the first broad wall is at least one of: covered by a first broadband electromagnetic absorber and at least partially filled with a second broadband electromagnetic absorber, the second broad wall is also at least one of: covered by the first broadband electromagnetic absorber and at least partially filled with the second broadband electromagnetic absorber.

Example 20 includes the rectangular waveguide device of Example 19, wherein the first broadband electromagnetic absorber and the second broadband electromagnetic absorber comprise the same material.

Example 21 includes a method, comprising: create at least one slot in a broad wall of a first portion of a rectangular waveguide, where the at least one slot in the broad wall of a first portion is configured to suppress undesirable higher order modes; and attaching the first portion to the second portion.

Example 22 includes the method of Example 21, further comprising creating at least one slot in a broad wall of a second portion of the rectangular waveguide, where the at least one slot in the broad wall of a first portion and the at least one slot in the broad wall of the second portion are configured to suppress undesirable higher order modes Example 23 includes the method of any of Examples 21-22, further comprising adding broadband electromagnetic absorber at least one of over or at least partially in at least one of (a) the at least one slot in the broad wall of the first portion and (b) at least one slot in the broad wall of the second portion.

Example 24 includes the method of any of Examples 21-23, further comprising mounting at least one ferrite portion in the at least first portion.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A phase shifter, comprising:

a first broad wall having a first surface;

a second broad wall parallel to the first broad wall and having a second surface;

a first narrow wall perpendicular to and connected to the first broad wall and the second broad wall;

a second narrow wall parallel to the first narrow wall and connected to the first broad wall and the second broad wall;

at least one ferrite portion having a third surface and a fourth surface;

wherein the first surface contacts the third surface;

wherein the second surface contacts the fourth surface;

at least one slot in the first broad wall; and wherein each slot is one of: covered by a first broadband electromagnetic absorber, at least partially filled with a second broadband electromagnetic absorber, or covered by a conductor.

2. The phase shifter of claim 1, wherein the first broadband electromagnetic absorber and the second broadband electromagnetic absorber comprise the same material.

3. The phase shifter of claim 1, wherein a slot covered by a conductor is at least partially filled with the first broadband electromagnetic absorber.

4. The phase shifter of claim 1, wherein the at least one slot comprises three or more slots each of which is covered by a conductor;

wherein two or more of the covered slots have a different lengths, and wherein spacings between two or more sets of two of the covered slots are different.

5. The phase shifter of claim 1, wherein the end of a slot proximate to an end of the phase shifter is displaced, from the end of the phase shifter, by less than one half of a wavelength of the lowest wavelength of an operating band of a fundamental mode in the phase shifter.

6. The phase shifter of claim 1, further comprising at least one slot in the second broad wall.

7. The phase shifter of claim 6, wherein the at least one slot of the second broad wall is identical to the at least one slot of the first broad wall; and if the at least one slot of the first broad wall is at least one of: covered by a first broadband electromagnetic absorber and at least partially filled with a second broadband electromagnetic absorber, the second broad wall is also at least one of: covered by the first broadband electromagnetic absorber and at least partially filled with the second broadband electromagnetic absorber.

8. The phase shifter of claim 7, wherein the first broadband electromagnetic absorber and the second broadband electromagnetic absorber comprise the same material.

9. A method, comprising:

creating at least one slot in a broad wall of a first portion of a rectangular waveguide;

mounting at least one ferrite portion in the first portion;

attaching the first portion to a second portion of the rectangular waveguide; and for each slot in the broad wall of the first portion, covering the slot with a first broadband electromagnetic absorber, at least partially filling the slot with a second broadband electromagnetic absorber, or covering the slot with a conductor.

10. The method of claim 9, further comprising creating at least one slot in a broad wall of the second portion of the rectangular waveguide; and for each slot in the broad wall of the second portion, covering the slot with a first broadband electromagnetic absorber, at least partially filling the slot with a second broadband electromagnetic absorber, or covering the slot with a conductor.

* * * * *